United States Patent [19]

Curren et al.

[11] 3,991,932

[45] Nov. 16, 1976

[54] BLANKS FOR FORMING CARTONS OR THE LIKE AND RESULTING CARTONS

[75] Inventors: Roger L. Curren, Corning; Lewis F. Reas, Big Flats, both of N.Y.

[73] Assignee: Corning Glass Works, Corning, N.Y.

[22] Filed: Mar. 12, 1976

[21] Appl. No.: 666,340

[52] U.S. Cl. ..... 229/35
[51] Int. Cl.[2] ..... B65D 5/26
[58] Field of Search ..... 229/35

[56] References Cited

UNITED STATES PATENTS

| | | | |
|---|---|---|---|
| 2,488,705 | 11/1949 | Buttery et al. | 229/35 |
| 2,488,706 | 11/1949 | Buttery et al. | 229/35 |
| 2,712,409 | 7/1955 | Buttery | 229/35 |
| 2,718,998 | 9/1955 | Bemiss | 229/35 |
| 3,185,381 | 5/1965 | Fobiano et al. | 229/35 |
| 3,211,358 | 10/1965 | Pierce, Jr. | 229/35 |
| 3,226,006 | 12/1965 | Dunn | 229/35 |

*Primary Examiner*—Davis T. Moorhead
*Attorney, Agent, or Firm*—Charles W. Gregg; Burton R. Turner; Clarence R. Patty, Jr.

[57] ABSTRACT

A blank of a relatively thick material, such as corrugated cardboard or paperboard for example, foldable to form a carton, tray or the like having corners which are locked in their folded condition by selected edges of the folded material abutting and bearing against each other.

8 Claims, 6 Drawing Figures

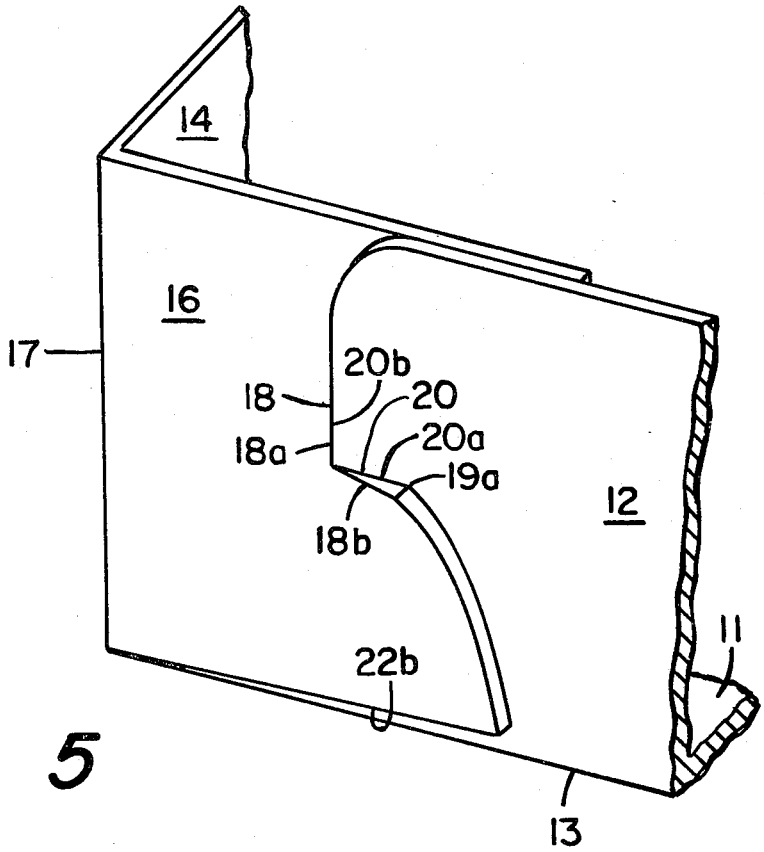
Fig. 5
Fig. 6
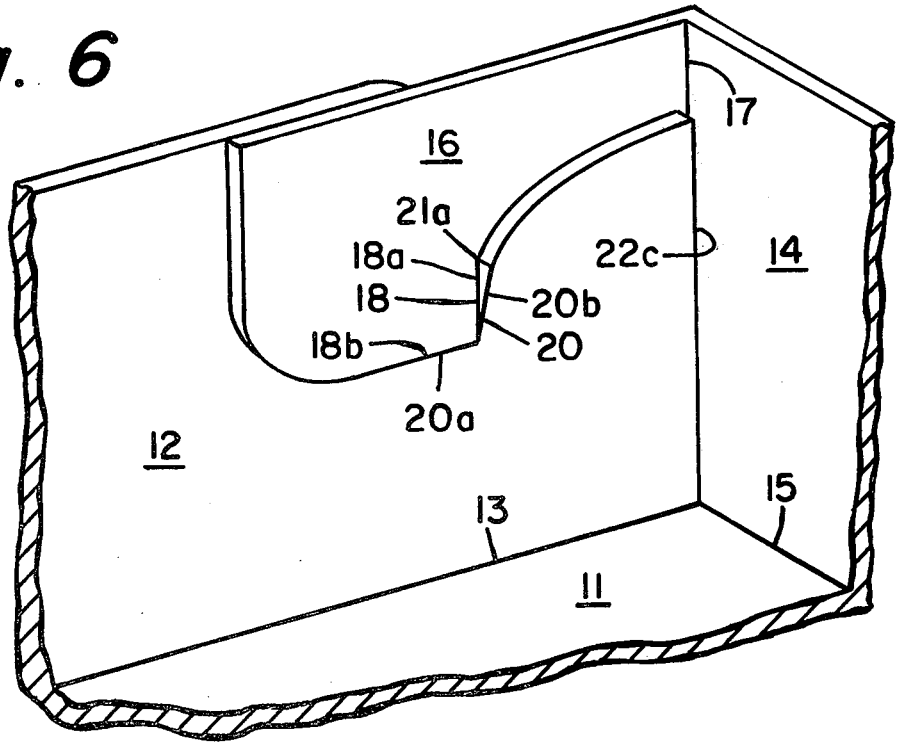

BLANKS FOR FORMING CARTONS OR THE LIKE AND RESULTING CARTONS

BACKGROUND OF THE INVENTION

Known cartons, containers, trays or the like made of blanks of foldable materials and having self-locking or interlocking corners usually embody merely point locking in such corners, that is, locking only at a point where a locking tab of a corner area and extending through a slot in such area contacts an end of such slot. As is well known, such self-locking or interlocking arrangements do not provide much sturdiness to cartons, trays, etc. folded out of the material blanks and, therefore, it is an object of this invention to provide a new and novel type of blank of foldable material providing for forming a carton or tray, etc. having relatively sturdy self-locking or interlocking corners.

It is another object of the invention to provide a tray, carton or the like of the type mentioned.

Other objects and characteristic features of the invention will become apparent as the description proceeds.

SUMMARY OF THE INVENTION

The invention is believed to be adequately summarized in the foregoing abstract of the disclosure and, therefore, to prevent repetition or redundancy to the extent possible, no further summary of the invention will be given nor is any believed necessary.

BRIEF DESCRIPTION OF THE DRAWINGS

In the drawings:

FIG. 5 is a perspective external view of a corner of a carton or the like formed from the blank in FIG. 1; and FIG. 6 is a perspective internal view of the corner of FIG. 5.

Similar reference characters refer to similar parts in each of the Figs. of the drawings.

PREFERRED EMBODIMENT OF THE INVENTION

Figure 1:
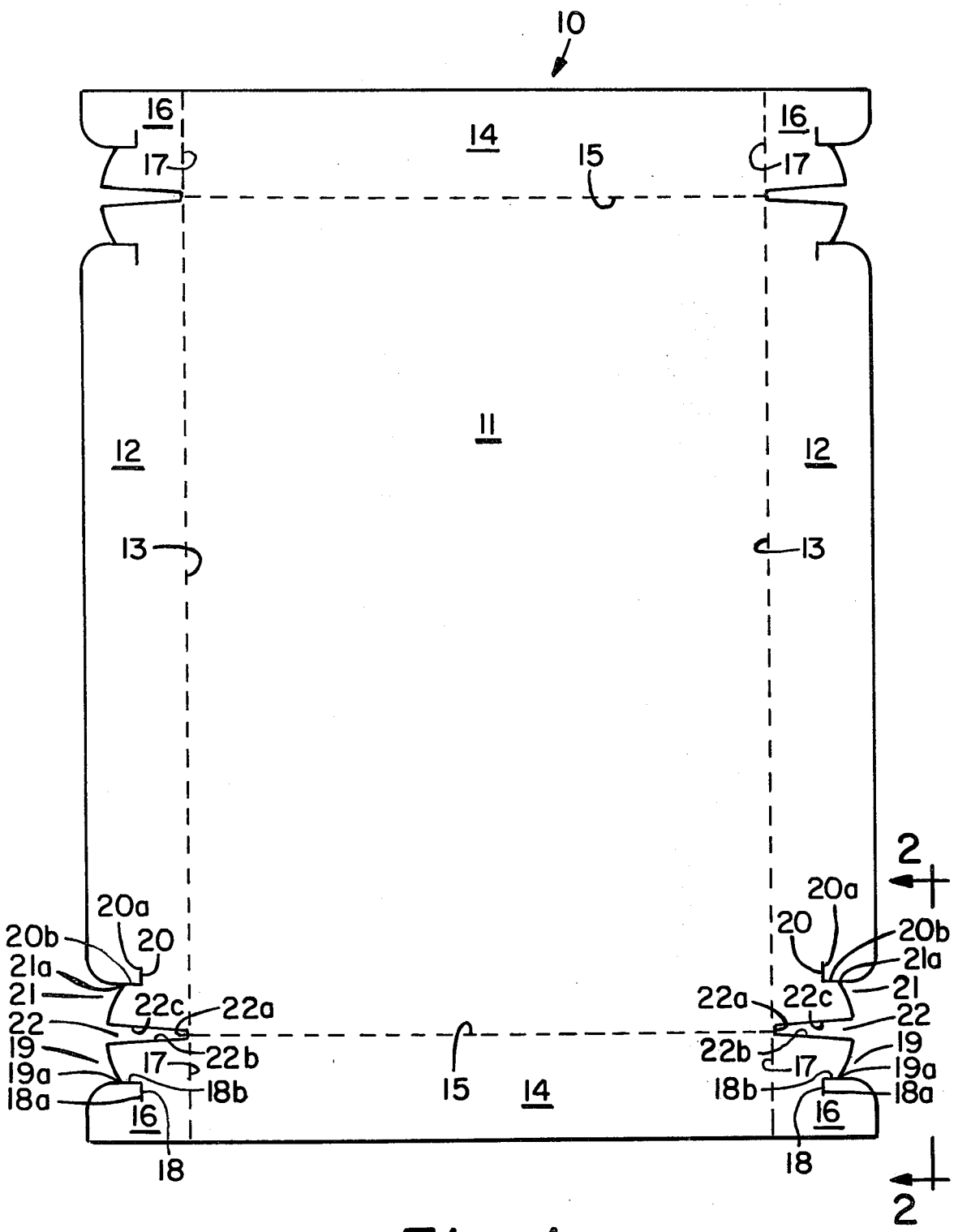
FIG. 1 is a top plan view of a blank of foldable material embodying the invention.

Referring to the drawings in detail, there is shown in FIG. 1 a blank 10 of a relatively thick material such as corrugated cardboard or paperboard for example. Such blank 10 includes a bottom panel 11, a pair of side panels such as 12 hinged to the side edges of panel 11 along creases or crease lines such as 13 and a pair of end panels such as 14 hinged to the end edges of bottom panel 11 along creases or crease lines such as 15. Hinged to each of the ends of each end panel such as 14 and along creases or crease lines such as 17 is a locking tab such as 16. It is believed that this is readily apparent from a glance at FIG. 1.

Each of the locking tabs such as 16 embodies a slit and notch arrangement including a 90° or right angle slit such as 18 having a first leg or base portion such as **18*a* which extends from approximately the center of the respective tab 16 parallel with the end of the respective end panel 14 to which such tab 16 is hinged, that is, parallel with crease 17, toward a first outer edge of the respective tab 16. The second leg or upright portion of each right angle slit such as 18 extends from said center of each respective tab 16** towards the second or other outer edge of each such tab.

Each said slit and notch arrangement also includes in said second or other outer edge of the respective tab such as 16 a generally V-shaped notch such as 19 whose apex such as **19*a* connects with the end of the second leg or upright portion 18*a* of the respectively associated slot 18. Each generally V-shaped notch such as 19** may have straight sides but each such notch is preferably provided with convexly curved sides as shown in the drawings.

Each of the ends of the side panels such as 12 is provided with a slot and notch arrangement which is complementary to and is a mirror image of such arrangement in the respectively adjacent locking tab such as 16. Each such arrangement in the ends of the side panels 12 includes a right angle or 90° slit 20 including first and second legs **20*a* and 20*b*, respectively, corresponding to legs 18*a* and 18*b*, respectively, of slit 18, and a generally V-shaped notch 21 including an apex 21*a* as shown in FIG. 1. Each locking tab such as 16 is preferably separated from the end of the side panel, such as 12, adjacent thereto by a narrow V-shaped notch such as 22 preferably having a relatively flat apex such as 22*a* and sides such as 22*b* and 22*c***.

Figure 3:
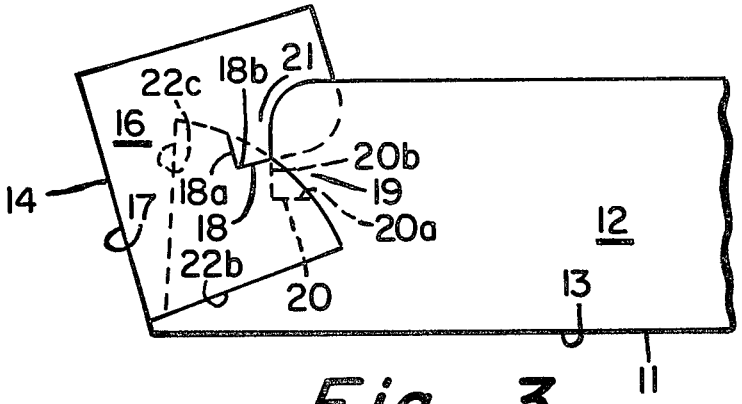
Figure 4:
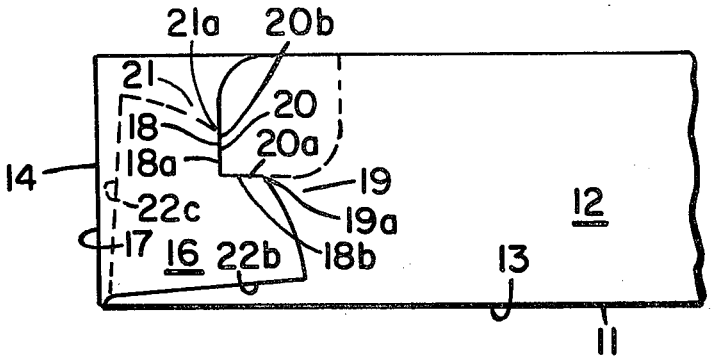

In forming a carton, tray or the like out of a blank such as 10, the side panels such as 12 of the blank are first folded up along the crease lines such as 13 (FIG. 1) the locking tabs such as 16 are then folded up along the crease lines such as 17 and then the end panels such as 14 are folded up along the crease lines such as 15. During the upward folding of the end panels such as 14 each locking tab such as 16 is manipulated as discussed below and as illustrated in FIGS. 2, 3 and 4 which illustrate, for example, the manipulation of the locking tab 16 of the right hand lower corner of the blank 10 shown in FIG. 1.

Figure 2:
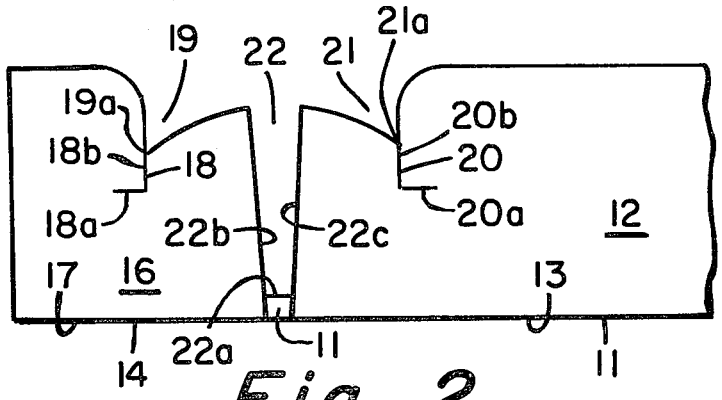
FIGS. 2 through 4 illustrate three stages in the forming of a carton corner by the folding of the blank of FIG. 1.

Following the folding of the side panels and locking tabs of a blank such as 10 as discussed above, the lower right hand corner of the blank when viewed along line 2—2 of FIG. 1 appears substantially as shown in FIG. 2. Now, as mentioned above, during the folding up of the lower end panel 14 (viewing FIG. 1) locking tab 16 is moved as shown in FIG. 3 with the upper left hand end portion of such tab being moved behind side panel 12 while the upper right hand end portion of the tab moves in front of side panel 12. At such time the sides **22*b* and 22*c* of V-notch 22 are moved past each other and the right angle slits such as 18 and 20 in locking tab 16 and side panel 12, respectively, are moved toward each other until finally, at the completion of the upward bending of end panel 14, the legs of said slits come into engagement with each other for locking or interlocking of the end panel 14 with the side panel 12 by a substantial portion of an edge of leg 18*a* of slit 18 overlapping and abutting and bearing against a substantial portion of an edge of leg 20*b* of slit 20 while a substantial portion of an edge of leg 18*b* of slit 18 overlaps and abuts and bears against a substantial portion of an edge of leg 20*a* of slit 20. This is best illustrated in the perspective views of FIGS. 5 and 6 which illustrates said edges overlapping each other. Such overlapping edges of the legs of the right angle slits lock or interlock said corner of blank 10 in a relatively secure and permanent manner. The remaining or other three corners of the folded blank such as 10** are, of course, manipulated to lock or interlock in a similar manner to form the completed desired carton, tray or the like.

Although there is herein shown and described only one form of a foldable blank embodying the invention, it will be understood that such is not to be considered in any way limiting but that various changes and modifications may be made therein within the purview of the appended claims without departing from the spirit and scope of the invention.

What is claimed is:

1. A blank of a relatively thick material foldable to form a carton or the like, such blank comprising:

A. a rectangular bottom panel;

B. side panels hinged to the side edges of said bottom panel;

C. end panels hinged to the end edges of said bottom panel;

D. a locking tab hinged to each end of each said end panel, each such locking tab embodying a slit and notch arrangement including;

I. a right angle slit having a first leg extending from approximately the center of the respective locking tab parallel with the end of the end panel to which such locking tab is hinged and toward an outer edge of such tab, and a second leg extending from said center towards another outer edge of said tab; and II. in said other outer edge of said tab, a generally V-shaped notch whose apex connects with the end of said second leg of said slit; and, E. each end of each of said side panels of said blank embodying a slit and notch arrangement which is complementary to and is a mirror image of such arrangement in the respectively adjacent locking tab.

2. A carton or the like made from the blank of claim 1 and in which each of the associted pairs of said complementary slit and notch arrangements in said locking tabs and said ends of said side panels are interlocked with each other.

3. A blank in accordance with claim 1 and in which the sides of each of said notches are somewhat convexly curved.

4. A blank in accordance with claim 2 and in which the sides of each of said notches are somewhat convexly curved.

5. A blank in accordance with claim 1 and in which said locking tabs are each separated from the end of the side panel adjacent thereto by a narrow V-shaped notch having a relatively flat apex.

6. A blank in accordance with claim 2 and in which said locking tabs are each separated from the end of the side panel adjacent thereto by a narrow V-shaped notch having a relatively flat apex.

7. A blank in accordance with claim 3 and in which said locking tabs are each separated from the end of the side panel adjacent thereto by a narrow V-shaped notch having a relatively flat apex.

8. A blank in accordance with claim 4 and in which said locking tabs are each separated from the end of the side panel adjacent thereto by a narrow V-shaped notch having a relatively flat apex.

* * * * *